US006446917B2

(12) United States Patent
Dieckmann et al.

(10) Patent No.: US 6,446,917 B2
(45) Date of Patent: Sep. 10, 2002

(54) BRACKET FOR FASTENING THE SUPPORT PIPE OF A JOINT ARM AWNING

(75) Inventors: Martin Dieckmann; Sven Kröner, both of Mettingen; Bernhard Wessels, Rheine, all of (DE)

(73) Assignee: Schmitz-Werke GmbH & Co., Emsdetten (DE)

( * ) Notice: Subject to any disclaimer, the term of this patent is extended or adjusted under 35 U.S.C. 154(b) by 0 days.

(21) Appl. No.: 09/761,664

(22) Filed: Jan. 18, 2001

(51) Int. Cl.[7] ..... F16L 3/10; E04F 10/10
(52) U.S. Cl. ..... 248/74.4; 248/62; 248/273
(58) Field of Search ..... 248/65, 74.1, 74.4, 248/273, 316.6, 70, 73, 62; 160/78, 79

(56) References Cited

U.S. PATENT DOCUMENTS

| | | | | |
|---|---|---|---|---|
| 2,292,170 A | * | 8/1942 | Starkloff | 160/370 |
| 3,080,140 A | * | 3/1963 | Gohs et al. | 248/74.1 |
| 3,851,979 A | * | 12/1974 | Becker | 248/62 |
| 4,281,213 A | * | 7/1981 | Sciscione | 174/169 |
| 4,442,994 A | * | 4/1984 | Logsdon | 248/547 |
| 4,783,029 A | * | 11/1988 | Geppert et al. | 24/459 |
| 5,689,862 A | * | 11/1997 | Hayes et al. | 24/279 |
| 5,924,466 A | | 7/1999 | Kroner et al. | 160/78 |

FOREIGN PATENT DOCUMENTS

| | | |
|---|---|---|
| DE | 2319376 | 4/1973 |
| DE | 69101741 T2 | 5/1991 |
| DE | 29612904 U1 | 7/1996 |
| FR | 2165783 | 12/1971 |

* cited by examiner

*Primary Examiner*—Leslie A. Braun
(74) *Attorney, Agent, or Firm*—Browdy & Neimark, P.L.L.C.

(57) ABSTRACT

A bracket for fastening the support pipe of a joint arm awning on a wall comprises two flanges which are perpendicular to the wall and mounted thereon at a distance from, and parallel to, each other, wherein each flange has a support pipe bearing section in the shape of a segment of a circle and corresponding to the radius of curvature of the support pipe; wherein a first lower holding element in the shape of a segment of a circle is disposed between the flanges for pivotability relative to the flanges around the central longitudinal axis of the support pipe; and wherein a second holding element in the shape of a segment of a circle is mountable on the first holding element by screwing for the support pipe to be fixed.

9 Claims, 2 Drawing Sheets

BRACKET FOR FASTENING THE SUPPORT PIPE OF A JOINT ARM AWNING

BACKGROUND OF THE INVENTION

1. Field of the Invention

The invention relates to a bracket for fastening the support pipe of a joint arm awning to a wall.

2. Background Art

Various designs of brackets of the generic type are known; as a rule they comprise a setscrew for implementation of the setting of the angle of inclination.

SUMMARY OF THE INVENTION

It is an object of the invention to improve a bracket of the species such that ease of assembly is accompanied with simple adjustability of the angle of inclination, especially stable and solid setting being ensured in the mounted condition.

This object is attained by a bracket comprising two flanges which are perpendicular to the wall and mounted thereon at a distance from, and parallel to, each other, wherein each flange has a support pipe bearing section in the shape of a segment of a circle and corresponding to the radius of curvature of the support pipe, wherein a first lower holding element in the shape of a segment of a circle is disposed between the flanges for pivotability relative to the flanges around the central longitudinal axis of the support pipe, and wherein a second holding element in the shape of a segment of a circle is mountable on the first holding element by screwing for the support pipe to be fixed.

As a result of this design, the support pipe and the awning components joined thereto can be placed on the bearing surface once the brackets are mounted on the wall so that there is no need of the weight being borne during further setting and adjusting jobs. Adjustment of the angle of inclination can easily be implemented from below. The second holding element and the two screws which are perpendicular to each other help attain a very reliable assembly.

By advantage, the first holding element is provided in the shape of three quarters of a circle and the second holding element is provided in the shape of one quarter of a circle so that the support pipe is enclasped by both holding elements.

It can further be provided that the first holding element is united with the second holding element in an approximately horizontal direction by a first fastening screw and in the vertical direction by a second fastening screw.

Setting the angle of inclination of the first holding element is possible by means of a setscrew which runs in an approximately vertical direction and can be actuated from below.

By advantage it is provided that the first holding element has a longitudinal recess through which the setscrew passes and in which a connecting member disposed, which is pivotally mounted in the second holding element and has a threaded hole with which the setcrew engages.

In this case, the free end of the setscrew advantageously supports itself on a front surface of a fastener between the two flanges.

For adjustment of the angle of inclination of the first holding element to be implemented, the flanges have at least one oblong hole in the shape of a segment of a circle and concentric of the central longitudinal axis of the support pipe, the first holding element having corresponding threaded holes with which engage fastening screws passing from outside through the oblong holes.

Preferably, two of these oblong holes are disposed on each flange at a distance from each other.

The support pipe may have a longitudinal groove for a cam to engage with which is non-rotatably joined to the first holding element.

Details of the invention will become apparent from the ensuing description of a preferred exemplary embodiment, taken in conjunction with the drawing.

DESCRIPTION OF THE PREFERRED EMBODIMENT

Figure 2:
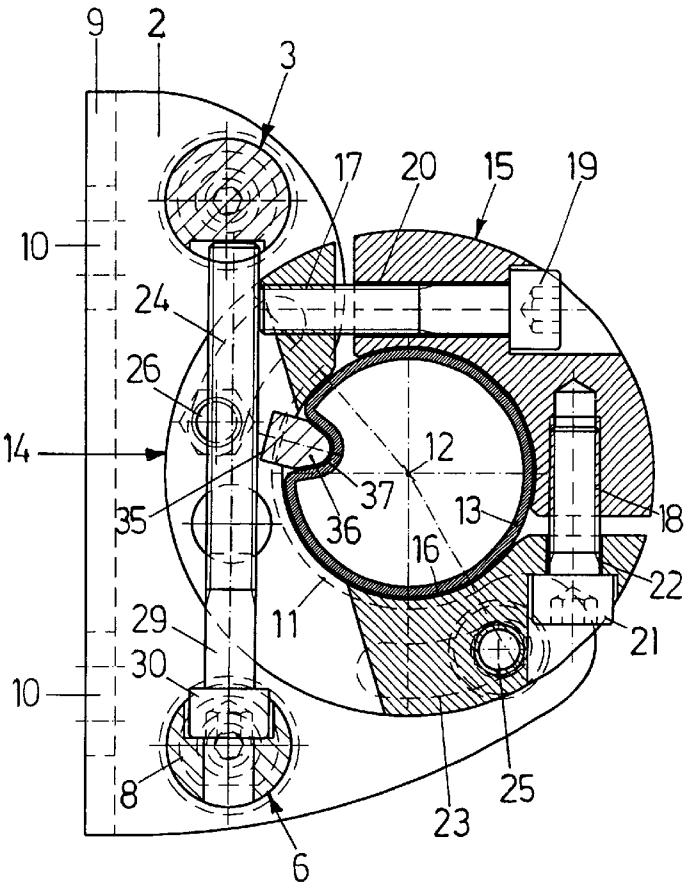
FIG. 2 is a side view partially broken open.
Figure 1:
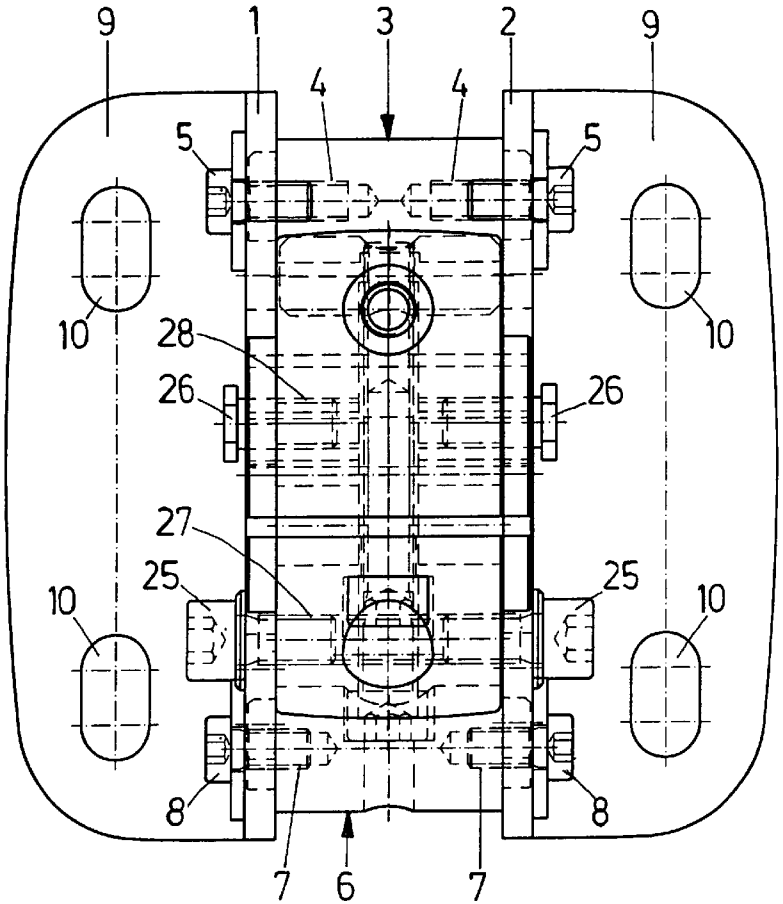
FIG. 1 is a plan view of a bracket according to the invention.
Figure 4:
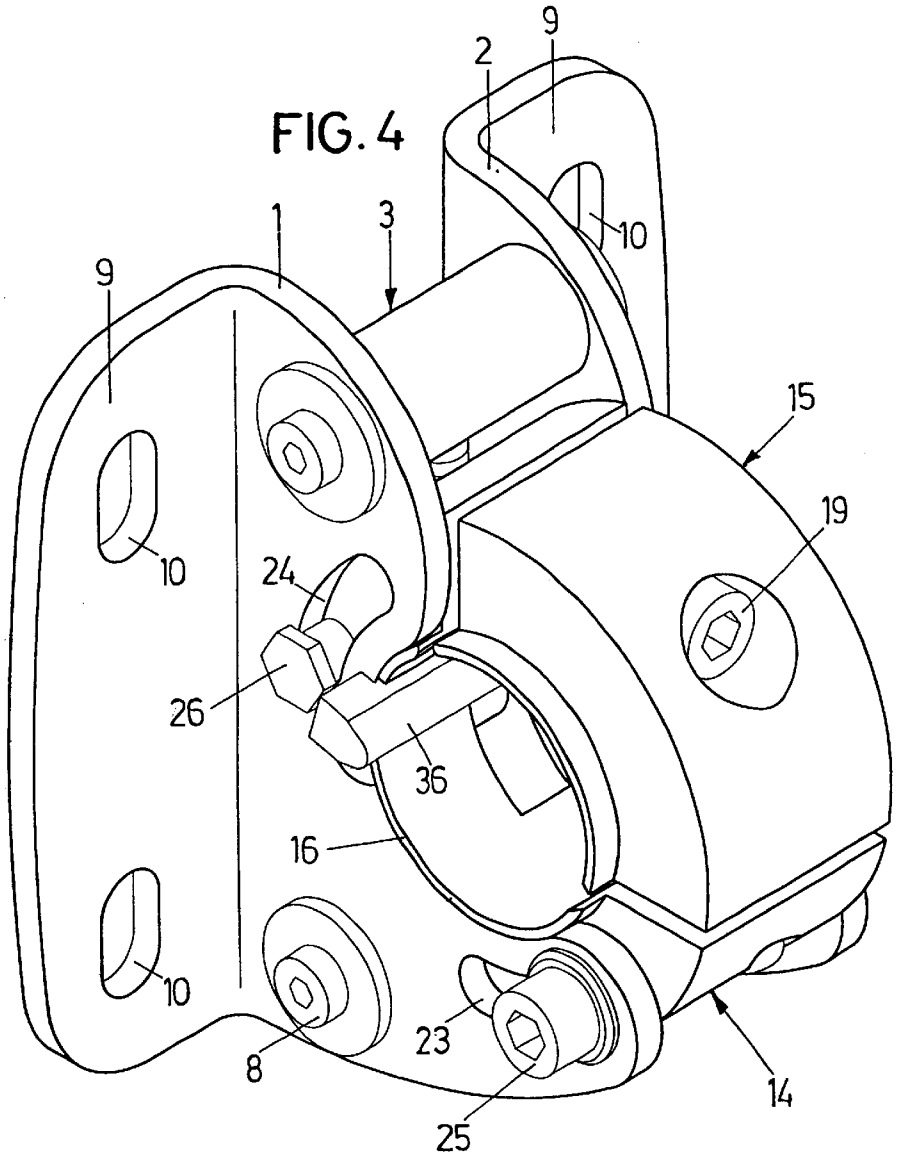
FIG. 4 is a perspective view at an angle from the side.

A bracket seen in the drawing comprises two flanges 1, 2, which are parallel to, and spaced from, each other and which are united by a first fastener 3 with threaded holes 4 and screws 5 as well as by a second fastener 6 with threaded holes 7 and screws 8. The flanges 1, 2 are perpendicular to the wall on which they are to be mounted, each of them having an appendix 9 which is parallel to this wall and perpendicular to the flanges and which has screw holes 10.

Each of the flanges 1, 2 comprises a bearing section 11 which has an upper side in the shape of a segment of a circle and which is concentric of the central longitudinal axis 12 of a support pipe 13 of the joint arm awning that is to be mounted and which has the same radius of curvature as the support pipe 13.

Pivotally mounted between the flanges 1, 2 is a first holding element 14 in the configuration of three quarters of a circle, having an inner bearing surface 16 which has the shape of a segment of a circle and which is concentric of the central longitudinal axis 12 of the support pipe 13 and which possesses the same radius of curvature as the support pipe 13.

A second holding element 15 has the shape of one quarter of a circle and is complemented by the first holding element 14 to form a circular holder. The second holding element 15 also comprises an inner bearing surface 16 which has the shape of a segment of a circle and which is concentric of the central longitudinal axis 12 of the support pipe 13 and which has the same radius of curvature as the support pipe 13.

The first holding element 14 has a horizontal threaded hole 17 on its upper side. The second holding element 15 is provided with a vertical threaded hole 18. A fastening screw 19 may be screwed through a horizontal hole 20 of the second holding element 15 into the threaded hole 17 of the first holding element 14. Another fastening screw 21 can be screwed from below through a vertical drilled hole 22 of the first holding element 14 into the threaded hole 18 of the second holding element 15.

This design ensures that the support pipe 13, during assembly, can first be placed on the bearing section 11 and then, in the state of load relief, the second holding element 15 can be fastened by means of the screws 19 and 21.

For pivotal bearing to be put into practice for the first holding element and indirectly also for the second holding element 15, a lower and an upper oblong hole 23, 24 are provided in each flange 1, 2; they have the configuration of a segment of a circle and are concentric of the central longitudinal axis of the support pipe 12.

Fastening screws 25, 26 pass through the oblong holes 23, 24 and engage with threaded holes 27, 28 of the first holding element 14, enabling the flanges 1, 2 to be clamped relative to the first holding element 14. This helps fix a set angle of inclination of the first holding element 14.

Upon release of the screws 25, 26, the angle of inclination of the holding element 14 can be set by means of a setscrew 29, the head 30 of which is accessible from below.

Figure 3:
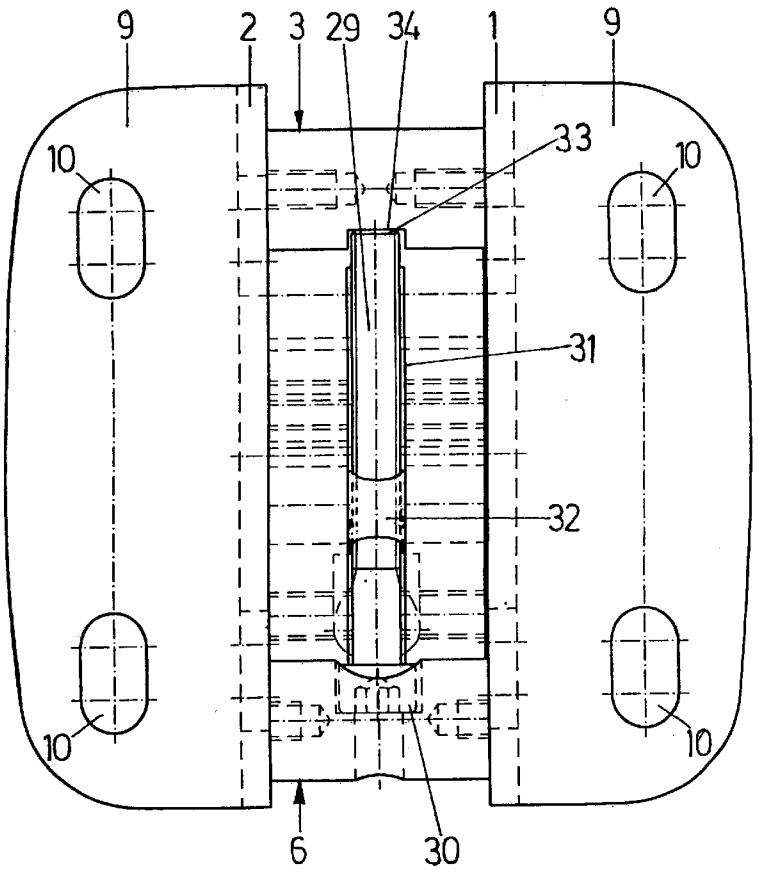
FIG. 3 is a rear view.

As seen in particular in FIG. 3, the setscrew 29 extends in a recess 31 of the first holding element 14. In this recess 31, provision is made for a connecting member 32 with a threaded hole through which passes the setscrew 29 by its external thread, the free end 33 of the setscrew 29 supporting itself on a front surface 34 of the connecting element 3. Correspondingly, the first holding element 14 may be pivoted by rotation of the setscrew 29.

Conferring this pivotal motion of the first holding element 14 to the support pipe 13 takes place by means of a cam 36 which is non-rotatably joined to the first holding element 14 and which is inserted in a recess 35 thereof and engages with a longitudinal groove 37 of the support pipe 13.

What is claimed is:

1. A bracket for fastening a support pipe of a joint arm awning on a wall, comprising two flanges (1, 2) which are perpendicular to the wall and mounted thereon at a distance from, and parallel to, each other, wherein each flange (1, 2) has a support pipe (13) bearing section (11) in the shape of a segment of a circle and corresponding to a radius of curvature of the support pipe (13); wherein a first lower holding element (14) in the shape of a segment of a circle is disposed between the flanges (1, 2) for pivotability relative to the flanges (1, 2) around a central longitudinal axis of the support pipe (13); and wherein a second holding element (15) in the shape of a segment of a circle is mountable on the first holding element (14) by screwing for the support pipe (13) to be fixed.

2. The bracket according to claim 1, wherein the first holding element (14) has the shape of approximately three quarters of a circle and the second holding element (15) has the shape of approximately one quarter of a circle.

3. The bracket according to claim 2, wherein the first holding element (14) is united with the second holding element (15) in an approximately horizontal direction by a first fastening screw (19) and in an approximately vertical direction by a second fastening screw (21).

4. The bracket according to claim 2, wherein the angle of inclination of the first holding element (14) is adjustable by a setscrew (29) which runs in an approximately vertical direction and is actuated from below.

5. The bracket according to claim 4, wherein the first holding element (14) has a longitudinal recess (31) through which the setscrew (29) passes and in which a connecting member (32) is disposed wherein the connecting member (32) and has a threaded hole with which the setscrew (29) engages.

6. The bracket according to claim 5, wherein the free end (33) of the setscrew (29) supports itself on a front surface (34) of a fastener (3) between the two flanges (1, 2).

7. The bracket according to claim 1, wherein for adjustment of the angle of inclination of the first holding element (14) to be implemented, the flanges (1, 2) have at least one oblong hole (23, 24) in the shape of a segment of a circle and concentric of the central longitudinal axis (12) of the support pipe (13); and wherein the first holding element (14) has corresponding threaded holes with which engage fastening screws (25, 26) passing from outside through the oblong holes (23, 24).

8. The bracket according to claim 7, wherein two oblong holes (23, 24) are disposed on each flange (1, 2) at a distance from each other.

9. The bracket according to claim 1, wherein the support pipe (13) has a longitudinal groove (37) for a cam (36) to engage with which is non-rotatably joined to the first holding element (14).

* * * * *